United States Patent [19]

Timoschuk

[11] Patent Number: 4,484,613

[45] Date of Patent: Nov. 27, 1984

[54] WIRE DRUM FOR DOOR

[76] Inventor: Walter Timoschuk, 19 Place de Bohème, Candiac, Quebec, Canada, J5R 3N2

[21] Appl. No.: 501,192

[22] Filed: Jun. 6, 1983

Related U.S. Application Data

[63] Continuation-in-part of Ser. No. 307,642, Oct. 1, 1981.

[51] Int. Cl.[3] ..... E05F 11/00

[52] U.S. Cl. ..... 160/193

[58] Field of Search ..... 160/189–193

[56] References Cited

U.S. PATENT DOCUMENTS

| | | | |
|---|---|---|---|
| 437,597 | 9/1890 | Hicks | 160/193 |
| 1,994,142 | 3/1935 | Madsen | 160/191 |
| 2,660,753 | 12/1953 | Moler | 160/191 |
| 3,038,535 | 6/1962 | Stroup et al. | 160/191 |

*Primary Examiner*—Peter M. Caun

[57] ABSTRACT

An improved door elevating system for use with a door having a plurality of horizontal door panels hinged together at their horizontal edges and guided at their vertical edges between a pair of guide rails. The system comprises means to displace the door along the guide rails and having a door lifting cable secured at one end to a bottom portion of the door and extending along a vertical edge of the door. An opposed end of the cable is wound on a rotatable drum rotatably supported in alignment with the vertical edge. The drum has an outer cable receiving surface on which the cable can be wound. The drum further has a vertical bearing side face and a free side face. The free side face faces inwardly of the door and a cable passage is provided inside the drum and has an exit port in the free side face whereby the opposed end of the cable exits. An adjustable fastening means is provided to secure the cable in the passage.

3 Claims, 4 Drawing Figures

WIRE DRUM FOR DOOR

This is a continuation-in-part application of U.S. patent application Ser. No. 307,642 filed Oct. 1, 1981.

BACKGROUND OF THE INVENTION

Field of Invention

The present invention relates to an improved door elevating system for use with doors constructed of horizontal panels hinged together at their horizontal edges and guided at their vertical edges between a pair of guide rails. More particularly the invention is concerned with an improved door lifting mechanism having easy adjusting and safety features.

SUMMARY OF THE INVENTION

According to a broad aspect of the present invention there is provided an improved door elevating system for use with a door having a plurality of horizontal door panels hinged together at their horizontal edges and fuided at their vertical edges between a pair of guide rails. The system comprises means to displace the door along the guide rails and having a door lifting cable secured at one end to a bottom portion of the door and extending along a vertical edge of the door. An opposed end of the cable is wound on a rotatable drum rotatably supported in alignment with the vertical edge. The drum has an outer cable receiving surface on which the cable can be wound. The drum further has a:ertical bearing side face and a free side face. The free side face faces inwardly of the door and a cable passage is provided inside the drum and has an exit port in the free side face whereby the opposed end of the cable exits. An adjustable fastening means is provided to secure the cable in the passage.

BRIEF DESCRIPTION OF DRAWINGS

A preferred embodiment of the invention will now be described with reference to the accompanying drawings, in which.

DESCRIPTION OF PREFERRED EMBODIMENTS

Figure 2:
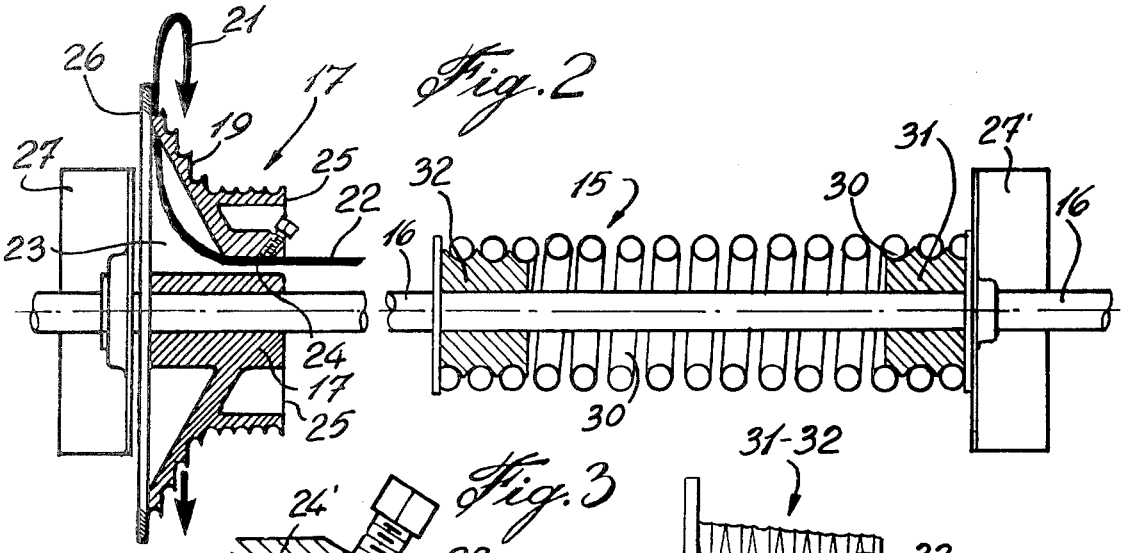
FIG. 2 is a section view showing the construction of the rotatable drum and torsion spring.

Referring to the drawings there is shown at 10 a door utilized with the present invention and comprised of a plurality of horizontal door panels 11 hinged together at their horizontal edges 12 and guided at their respective vertical edges 13 (one only being shown herein) between a pair of guide rails 14 (also only one being shown herein). Means, such as the torsion spring 15 or else a drive motor (not shown) imparts a rotational drive to the door shaft 16 whereby to cause a drum 17 to rotate and causing door lifting cable 18 to be wound on an outer surface 19 thereof to cause the door 10 to be lifted.

Cable 18 is provided at each opposed vertical edge of the door 10 and is associated with a respective one of two drums 17. The lower end 20 of the cable 18 is secured to a bottom portion of the bottom panel 11 and extends along the vertical edge 13 of the door. An opposed end portion 21 of the cable is wound about the outer surface 19 of the drum 17 with the opposed free end 22 of the cable passing through a cable passage 23 inside the drum 17. The cable passage has an exit port 24 which extends to a free inside side face 25 of the drum which faces inwardly of an outer drum bearing side face 26 adjacent to which a shaft support bearing plate 27 is mounted.

In the drum structures of the prior art, the cable entry into the drum is usually through the bearing side face 26 were access to the free end of the cable is very difficult, thus making it extremely difficult to adjust the length of the cable or install the cable on the drum due to restricted spaces in that area.

Figure 3:
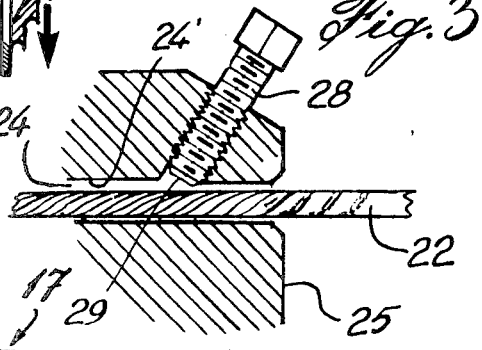
FIG. 3 is an enlarged fragmented section view of a portion of the drum.
Figure 4:
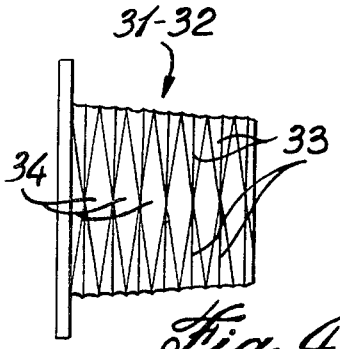
FIG. 4 is a side view of a universal threaded spring anchoring plug.

With further references to FIG. 3, it can be seen that with the present drum construction there is provided infinite and at the same time controlled cable adjustment. As shown in FIG. 3, and adjustable fastening means, herein a threaded bolt 28, is threadably engaged in the pulley whereby a cable engaging end 29 of the bolt is positioned in a side wall 24' of the exit port 24. By threading and unthreading the bolt 28 the cable is clamped in the port 24. For example, if it is necessary to release a certain length of cable, a clamping device (not shown), such as visegrips, grip the free end 22 of the cable at a location from the face 25 which is equal to the amount of cable to be released and by unthreading the bolt 28 the pull of the door 10 on the cable will bring the visegrip instantly in contact with the drum free side face 25. The screw 28 is then re-tightened.

As shown in FIG. 2 the means to displace the door also comprises a torsion spring 30 which is horizontally disposed as is well known in the art. However, this torsion spring is captive between its ends 30' and 30'' by a stationary bearing plug 31 and a spring winding plug 32, respectively. As shown in FIG. 3 the plugs 31 and 32 each have a universal thread 33 on an outer surface 34 with the thread disposed such as to cause the plugs 31 and 32 to tighten whether they are turned clockwise or counterclockwise. Such universal threads are well known in the art. Of course, the plugs 31 and 32 are slightly tapered to permit them to be wound within a respective end of the helically wound torsion spring 30. The stationary plug 31 is secured to the shaft bearing bracket 27' whilst the spring winding plug 32 is secured to the shaft 16 by a convenient screw 36. For simplicity of illustration, the plugs 31 and 32 are shown with only a few threads.

Figure 1:
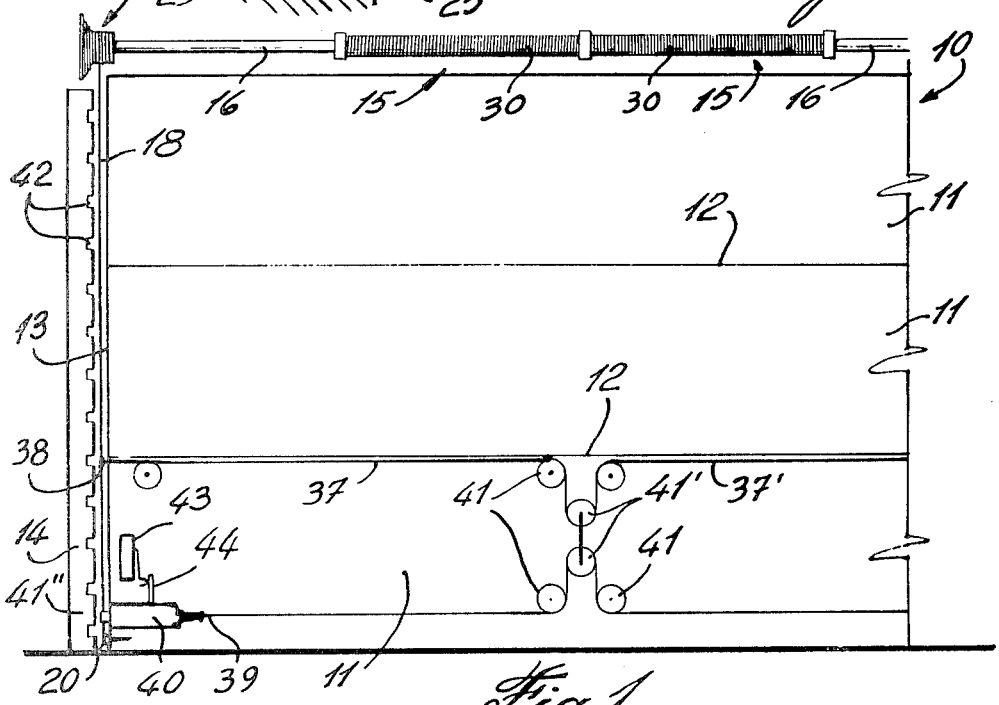
FIG. 1 is a fragmented plan view of a bottom section of a door of the type utilized with the present invention.

Referring to FIG. 1 there is shown a fail-safe device secured to the bottom panel section 11 of the door. This fail-safe device consists essentially of a pair of sensing wires 37, 37' connected respectively at 38 to the door lifting cables 18, only one being shown herein, and secured at its opposed end 39, through double floating sheaves 41' to a strike bolt 40. The wires 37, 37' are taut and guided by suitable pulleys 41.

With this arrangement it can be seen that if the cables 18 were to slacken or break, this would cause the sensing wire 37 or 37' to slaken thereby releasing the bolt head 41 which is spring-biased outwardly of the vertical edges 13 of the door. As the door descends, due to any one of the cables 18 slacking or breaking, both bolt heads will engage in the slots 42 provided along the guide rails 14 immediately below their position (first slot encountered downwardly). Of course, an independent rail may be provided for the safety system. Thus, if a cable were to slacken or break, both bolts 40 would be actuated thereby locking the door into the track preventing the door to fall by gravity and cause injury or damage.

Sensing means in the form of a mechanical switch 43 may also be associated with the bolt 40 and engageable by a displaceable arm 44 associated with the movement of the bolt head 41" whereby to cut off the power of a drive motor, when associated with the door lifting mechanism.

It is within the ambit of the present invention to cover any obvious modifications of the example of the preferred embodiment described herein provided such modifications fall within the scope of the appended claims.

I claim:

1. An improved door elevating system for use with a door having a plurality of horizontal door panels hinged together at their horizontal edges and guided at their vertical edges between a pair of guide rails, said system comprising means to displace said door along said guide rails, said means comprising a door lifting cable disposed along a respective one of opposed vertical edges of said door, said cable being secured at one end to a bottom portion of said door, an opposed end portion of said cable being wound on a rotatable drum rotatably supported on a drive shaft and disposed in alignment with said vertical edge; said drum having an outer cable receiving surface on which said cable can be wound, a cable entry hole in said surface positioned adjacent said vertical edge of said door, a vertical outer bearing side face protecting said cable entry hole, and a free side face opposite from said cable entry hole; said free side face facing inwardly of said vertical edge of said door, a cable passage inside said drum spaced from said drive shaft and having an exit port in said free side face whereby said end of said cable exits for adjustment in an area providing easy access to said cable, adjustable fastening means to secure said cable in said passage, and a fail safety device having a pair of sensing wires each connected at one end to a respective one of said cables disposed along a respective one of said door vertical edges, said sensing wires being taut and guided by guide pulleys and connected at an opposed end to a respective strike bolt secured adjacent a respective one of said door vertical edges, said guide rails having bolt engaging means to receive and retain said bolts when said bolts are released by the slackening of said sensing wires due to loss of tension of any of said door lifting cables.

2. A door elevating system as claimed in claim 1 wherein said adjustable fastening means is a cable retention bolt having a cable engaging end adjustably positioned in a side wall of said exit post, said opposed end of said cable extending out of said exit post providing controlled cable adjustment.

3. A door elevating system as claimed in claim 2 wherein said drum is secured on a horizontal door shaft, said means to displace said door further comprising a torsion spring wound about said door shaft, said spring being captive between its ends by a stationary bearing plug and a spring winding plug, each of said plugs having an outer universal thread and being in threaded engagement with a respective end winding of said spring.

* * * * *